US011333317B2

(12) United States Patent
Kang

(10) Patent No.: US 11,333,317 B2
(45) Date of Patent: May 17, 2022

(54) LAMP FOR VEHICLE AND VEHICLE INCLUDING THE SAME

(71) Applicant: HYUNDAI MOBIS CO., LTD., Seoul (KR)

(72) Inventor: Hyun Woo Kang, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/344,482

(22) Filed: Jun. 10, 2021

(65) Prior Publication Data

US 2021/0388965 A1 Dec. 16, 2021

(30) Foreign Application Priority Data

Jun. 10, 2020 (KR) ..... 10-2020-0070546

(51) Int. Cl.
*F21S 45/48* (2018.01)
*F21S 41/29* (2018.01)
*F21S 41/27* (2018.01)

(52) U.S. Cl.
CPC ..... *F21S 45/48* (2018.01); *F21S 41/27* (2018.01); *F21S 41/295* (2018.01)

(58) Field of Classification Search
CPC ..... F21S 41/27; F21S 41/295; F21S 45/48
See application file for complete search history.

(56) References Cited

U.S. PATENT DOCUMENTS

2014/0233252 A1* 8/2014 Shibata ..... F21S 41/683 362/512

* cited by examiner

*Primary Examiner* — Thomas M Sember
(74) *Attorney, Agent, or Firm* — NovoTechIP International PLLC

(57) ABSTRACT

A lamp for an automobile and an automobile are disclosed. According to one aspect of the present disclosure, provided is a lamp for an automobile, the lamp including: a lens provided on the front outer side; a lens holder coupled to the lens to fix the lens; a heat dissipating module coupled to the lens holder in rear of the lens holder; a housing having a space configured to accommodate the lens, the lens holder, and the heat dissipating module, the housing having a through-hole which is provided in a rear side surface thereof and through which the heat dissipating module passes; and a sealing member provided between the heat dissipating module and the housing in the through-hole. The sealing member includes a protrusion-recess section having flexibility.

14 Claims, 5 Drawing Sheets

LAMP FOR VEHICLE AND VEHICLE INCLUDING THE SAME

CROSS-REFERENCE TO RELATED APPLICATION(S)

This application claims priority from and the benefit of Korean Patent Application No. 10-2020-0070546, filed on Jun. 10, 2020, which is hereby incorporated by reference for all purposes as if set forth herein.

TECHNICAL FIELD

Exemplary embodiments relate to a lamp for an automobile and an automobile including the lamp and, more particularly, to: a lamp for an automobile, which includes a heat dissipating module; and an automobile including the lamp.

BACKGROUND

Due to heat generation by light sources inside lamps mounted to an automobile, components for discharging heat generated in the lamps to the outside are generally provided in the automobile. For example, heat sinks or fans may be provided around the lamps so as to discharge the heat generated from the light sources of the lamps to the outside.

Meanwhile, as lamp performance required in the automobile is increased, power consumption of the light sources provided in the lamps are also increased. However, the increase in power consumption of the light sources represents an increase in heat generated from the light sources as much as the increase in power consumption. In order to mount a lamp equipped with a light source having high power consumption, a heat sink having a large size or a fan having enhanced performance may be installed in an automobile. However, this causes an increase in the overall weight of the automobile or an increase in the power consumption of the automobile.

SUMMARY

Exemplary embodiments of the present disclosure provide manufacture of a lamp for an automobile, which is equipped with a heat sink having improved heat dissipation efficiency as compared to the related art.

A first exemplary embodiment of the present disclosure provides a lamp for an automobile, the lamp including: a lens provided on the front outer side; a lens holder coupled to the lens to fix the lens; a heat dissipating module coupled to the lens holder in rear of the lens holder; a housing having a space configured to accommodate the lens, the lens holder, and the heat dissipating module, the housing having a through-hole which is provided in a rear side surface thereof and through which the heat dissipating module passes; and a sealing member provided between the heat dissipating module and the housing in the through-hole, wherein the sealing member includes a protrusion-recess section having flexibility.

A plurality of protrusion portions may be provided in the protrusion-recess section, and each of the plurality of protrusion portions may protrude in a forward or rearward direction, which is a direction in which the heat dissipating module passes through the housing.

The housing may include a hook portion which is provided along a circumference of the through-hole and has a hook shape configured to interfere with one end of the sealing member when the sealing member moves in the forward direction.

The heat dissipating module may include a connection portion that faces the sealing member, wherein the connection portion includes an interference member which protrudes toward the sealing member to interfere with the sealing member when the sealing member moves in the forward or rearward direction.

The heat dissipating module may further include: a fixing portion provided in an inner space of the housing and coupled to the lens holder; a first heat dissipating fin provided in rear of the fixing portion within the inner space of the housing; and a second heat dissipating fin provided in an outer space of the housing, wherein the connection portion is provided between the first heat dissipating fin and the second heat dissipating fin.

The interference member may include: a first interference member provided in front of the sealing member; and a second interference member provided in rear of the sealing member.

A height of the first interference member may be greater than a height of the second interference member.

The sealing member may be inserted between the first interference member and the second interference member.

A corrugated portion may be provided in an area of the hook portion, which is in contact with the end of the sealing member.

A corrugated portion may be provided in an area of the connection portion, which is between the first interference member and the second interference member.

The protrusion-recess section provided in the sealing member may include: a first protrusion portion protruding in the rearward direction and fastened to the hook portion in a hook coupling manner; a second protrusion portion protruding in the rearward direction and interfering with the interference member when the sealing member moves in the forward or rearward direction; and a third protrusion portion protruding in the forward direction and provided between the first protrusion portion and the second protrusion portion.

A thickness of the second protrusion portion may be less than a thickness of the first protrusion portion.

The first heat dissipating fin may include a vertical fin having a plate shape, and the second heat dissipating fin may include a pin-type fin.

A second exemplary embodiment of the present disclosure provides an automobile including a lamp for an automobile, wherein the lamp performs aiming in an up-down direction or in a left-right direction and includes: a lens provided on the front outer side; a lens holder coupled to the lens to fix the lens; a heat dissipating module coupled to the lens holder in rear of the lens holder; a housing having a space configured to accommodate the lens, the lens holder, and the heat dissipating module, the housing having a through-hole which is provided in a rear side surface thereof and through which the heat dissipating module passes; and a sealing member provided between the heat dissipating module and the housing in the through-hole, wherein the sealing member includes a protrusion-recess section having flexibility.

The aiming may be performed by rotating and moving the lens holder in the up-down direction or in the left-right direction.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for an automobile, and the automobile according to the present disclosure will be described with reference to the drawings.

Lamp for Automobile

Figure 1:
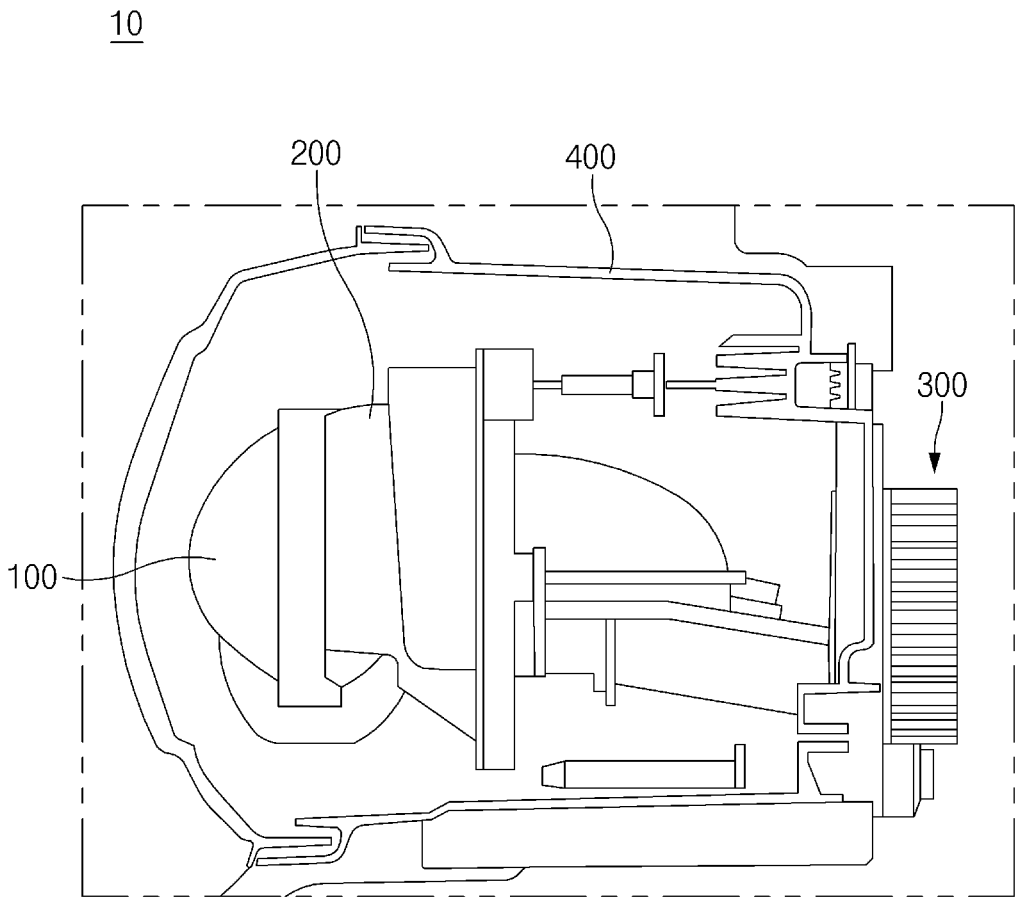
FIG. 1 is a vertical cross-sectional view of a lamp for an automobile according to the present disclosure.
Figure 2:
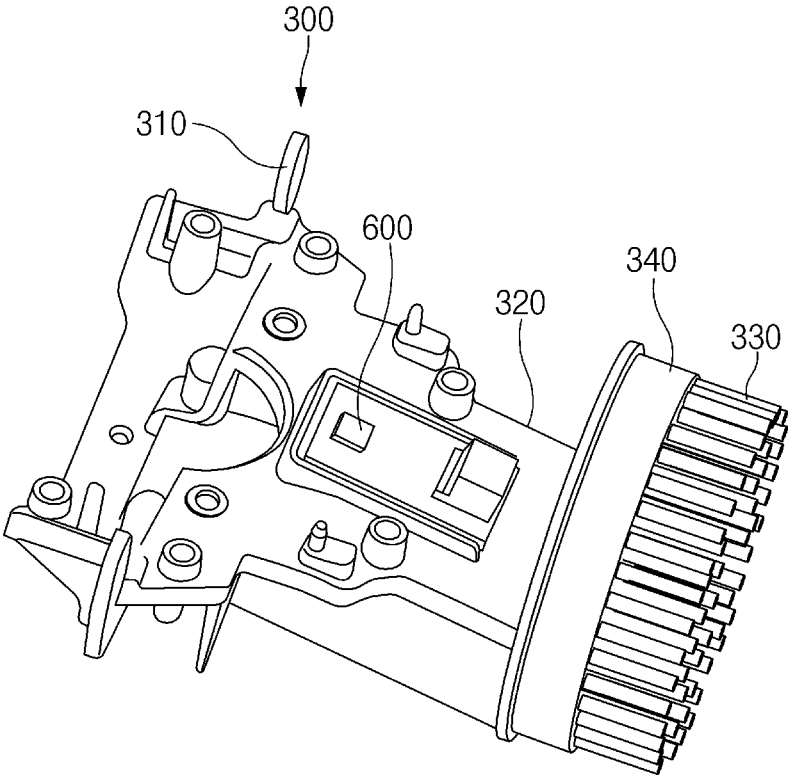
FIG. 2 is a perspective view illustrating a heat dissipating module and a light source in a lamp for an automobile according to the present disclosure.
Figure 3:
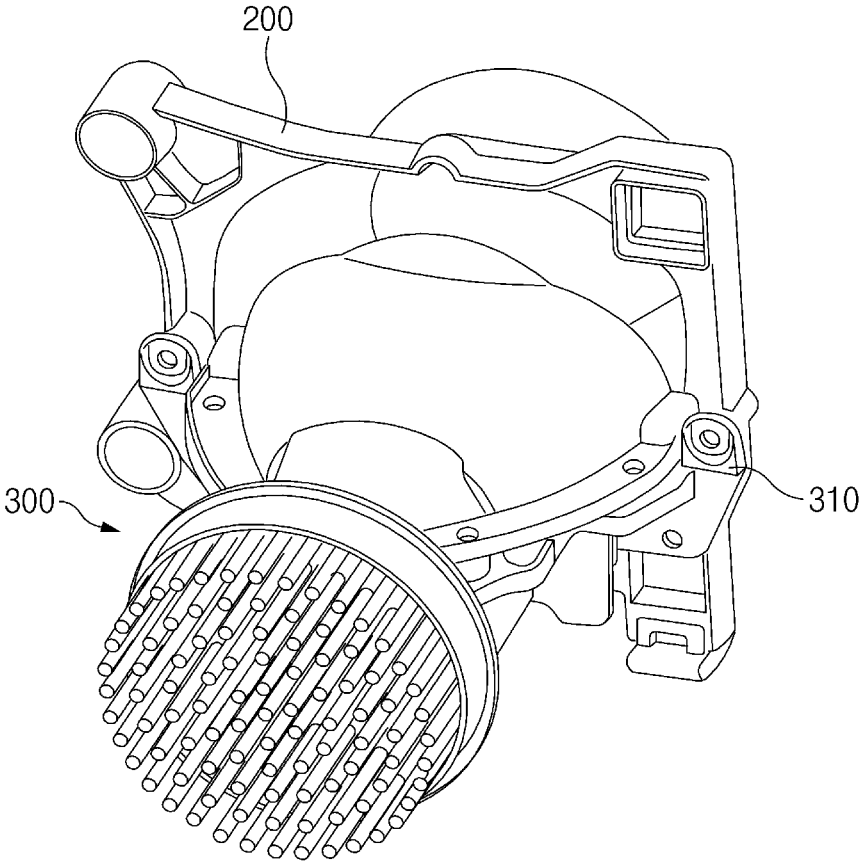
FIG. 3 is a perspective view illustrating a coupling structure between a lens holder and a heat dissipating module in a lamp for an automobile according to the present disclosure.
Figure 4:
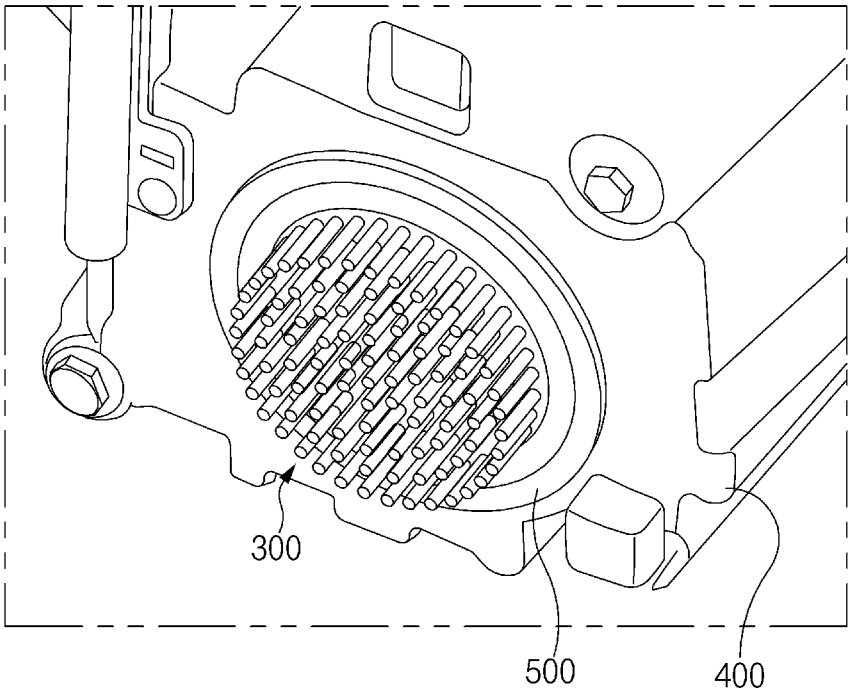
FIG. 4 is a perspective view showing a state in which a housing, a heat dissipating module, and a sealing member are coupled to each other in a lamp for an automobile according to the present disclosure.
Figure 5:
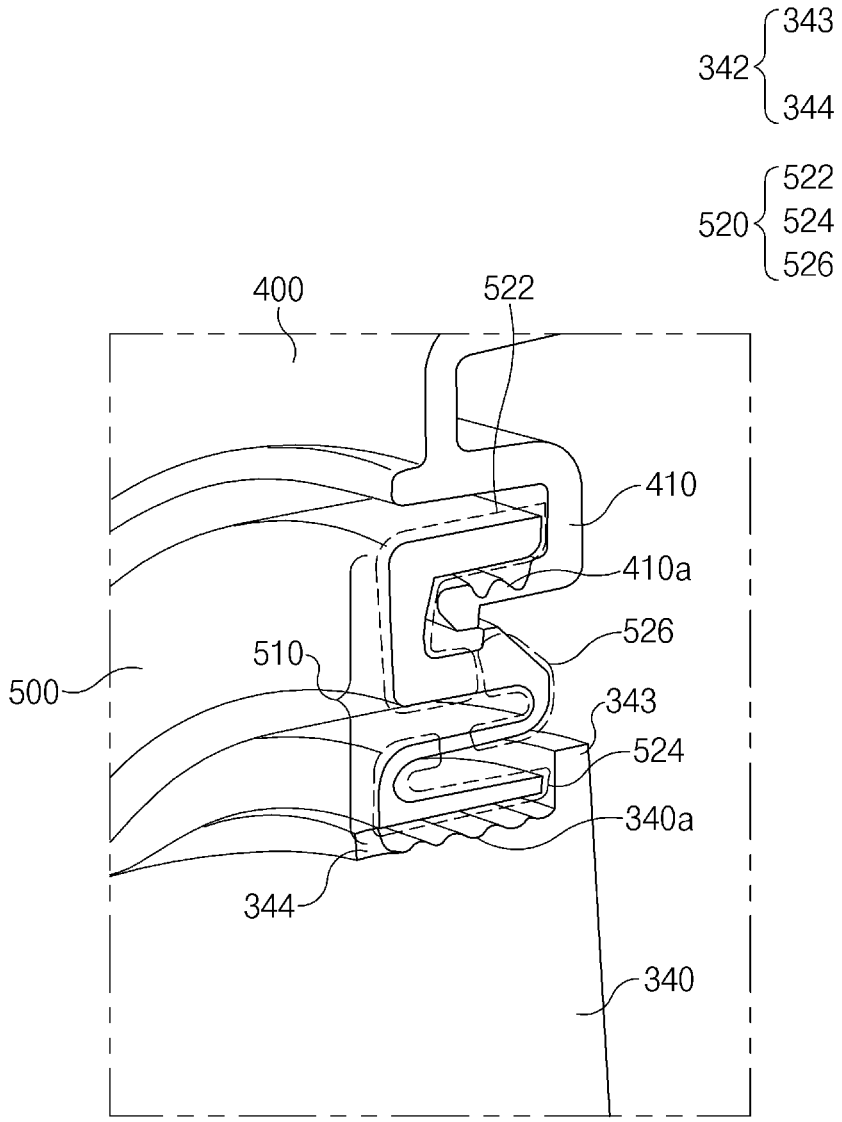
FIG. 5 is an enlarged cross-sectional view illustrating a coupling structure between a sealing member and a housing and a coupling structure between the sealing member and a heat dissipating module.

FIG. 1 is a vertical cross-sectional view of a lamp for an automobile according to the present disclosure, and FIG. 2 is a perspective view illustrating a heat dissipating module and a light source in a lamp for an automobile according to the present disclosure. Also, FIG. 3 is a perspective view illustrating a coupling structure between a lens holder and a heat dissipating module in a lamp for an automobile according to the present disclosure, and FIG. 4 is a perspective view showing a state in which a housing, a heat dissipating module, and a sealing member are coupled to each other in a lamp for an automobile according to the present disclosure. Also, FIG. 5 is an enlarged cross-sectional view illustrating a coupling structure between a sealing member and a housing and a coupling structure between the sealing member and a heat dissipating module.

As illustrated in FIGS. 1 to 5, a lamp 10 for an automobile (hereinafter, referred to as a 'lamp') according to the present disclosure may include: a lens 100 provided on the front outer side and a lens holder 200 coupled to the lens 100 to fix the lens 100. More specifically, a through-area may be provided in the front of the lens holder 200, and the lens 100 may be inserted into the through-area of the lens holder 200.

Also, the lamp 10 may include a heat dissipating module 300 coupled to the lens holder 200 in rear of the lens holder 200. As illustrated in FIG. 2, the heat dissipating module 300 may be configured to prevent the temperature of the lamp 10 from excessively rising by discharging, to the outside, heat generated from a light source 600 provided in the lamp 10. In particular, as described later, the heat dissipating module 300 according to the present disclosure may be configured to exhibit heat dissipation efficiency higher than that of a heat dissipating component according to the related art.

Continuing to refer to FIG. 1, the lamp 10 may further include a housing 400 having a space provided therein to accommodate the lens 100, the lens holder 200, and the heat dissipating module 300. As illustrated in FIG. 1, the entire region of the lens 100 and the entire region of the lens holder 200 may be accommodated in the inner space of the housing 400.

On the other hand, according to the present disclosure, only a portion of the heat dissipating module 300 may be accommodated in the inner space of the housing 400. For this, a through-hole may be provided in a rear side surface of the housing 400, and as illustrated in FIG. 1, the heat dissipating module 300 may pass through the housing 400 via the through-hole.

According to the present disclosure, a portion of the heat dissipating module 300 may be provided inside the housing 400, and the other portion of the heat dissipating module 300 may be provided outside the housing 400. Thus, the heat dissipating module 300 may absorb the heat, which is discharged from the light source 600, in the inside of the housing 400 and then autonomously discharge the heat to the outside of the housing 400, even though a separate component (for example, a fan) for forcibly transferring the heat to the outside is not added. Therefore, the heat dissipation efficiency may be improved without the addition of a separate component.

Also, referring to FIGS. 2 and 3, the heat dissipating module 300 may include a fixing portion 310 which is provided in the inner space of the housing 400 and coupled to the lens holder 200. That is, the heat dissipating module 300 may be fixed to the lens holder 200 by the fixing portion 310. Thus, when the lens holder 200 rotates in an up-down direction or in a left-right direction as described later, the heat dissipating module 300 may also correspondingly rotate in the up-down direction or in the left-right direction.

Also, the heat dissipating module 300 may further include a first heat dissipating fin 320 provided in rear of the fixing portion 310 within the inner space of the housing 400 and a second heat dissipating fin 330 provided in the outer space of the housing 400.

Also, as illustrated in FIG. 2, the lamp 10 may further include the light source 600 which generates and emits light. Here, the light source 600 may be mounted to the heat dissipating module 300.

When the heat dissipating module 300 passes through the housing 400 as described above, sealing between the heat dissipating module 300 and the housing 400 has to be ensured. For example, when moisture, air, or the like flows in through a space between the heat dissipating module 300 and the housing 400, overall performance and durability of the lamp may be significantly deteriorated.

In order to prevent this deterioration, the lamp 10 according to the present disclosure may further include, as illustrated in FIG. 4, a sealing member 500 provided between the heat dissipating module 300 and the housing 400 in the through-hole provided in the housing 400. Here, the sealing member 500 may include a material having flexibility. More preferably, the sealing member 500 may be made of a flexible material. In this case, since adhesion between the heat dissipating module 300 and the sealing member 500 and adhesion between the housing 400 and the sealing member 500 may be enhanced, the sealing between the heat dissipating module 300 and the housing 400 may also be improved.

Also, the lamp 10 according to the present disclosure may be configured to be able to perform aiming in an up-down direction or in a left-right direction. Here, the aiming may represent changing a direction in which light is emitted from the lamp 10.

Also, according to the present disclosure, the aiming may be performed by the lens holder 200. More specifically, the aiming of the lamp 10 according to the present disclosure may be performed by rotating and moving the lens holder 200 in the up-down direction or in the left-right direction.

When the lens holder 200 rotates and moves in the up-down direction or in the left-right direction, the heat dissipating module 300 fixed to the lens holder 200 is also rotated by the rotation of the lens holder 200.

Also, as described above, since the heat dissipating module 300 passes through the housing 400 via the through-hole provided in the housing 400, relative movement occurs between the heat dissipating module 300 and the housing 400 when the heat dissipating module 300 is moved by the aiming of the lamp 10. When this relative movement occurs, the sealing between the heat dissipating module 300 and the housing 400 is degraded, and thus, foreign substances such as moisture may flow in the inner space of the housing 400.

Thus, according to the present disclosure to solve the above limitation, the sealing member 500 may include a protrusion-recess section 510 having flexibility as illustrated in FIGS. 4 and 5. Here, the protrusion-recess section 510 has the flexibility, and this may be understood as that the geometric shape of the protrusion-recess section 510 is deformed when an external force is applied to the protrusion-recess section 510 and then restored to its initial geometric shape when the external force is removed, which is irrespective of whether or not a material constituting the protrusion-recess section 510 has flexibility.

When the protrusion-recess section 510 having the flexibility is provided in the sealing member 500, even if relative movement between the heat dissipating module 300 and the housing 400 occurs, reversible length deformation may occur, due to the relative movement, in the protrusion-recess section 510 of the sealing member 500 provided between the heat dissipating module 300 and the housing 400. Thus, the sealing between the heat dissipating module 300 and the housing 400 may be maintained.

Continuing to refer to FIG. 5, a plurality of protrusion portions 520 may be provided in the protrusion-recess section 510. Here, each of the plurality of protrusion portions 520 may protrude in a forward or rearward direction, which is a direction in which the heat dissipating module 300 passes through the housing 400. For example, as illustrated in FIG. 5, the plurality of protrusion portions 520 may include a first protrusion portion 522 provided to be in contact with the housing 400, a second protrusion portion 524 provided to be in contact with the heat dissipating module 300, and a third protrusion portion 526 provided between the first protrusion portion 522 and the second protrusion portion 524. Here, the first protrusion portion 522 and the second protrusion portion 524 may protrude in the rearward direction, and the third protrusion portion 526 may protrude in the forward direction. According to the present disclosure, when the relative movement occurs between the heat dissipating module 300 and the housing 400, the sealing between the heat dissipating module 300 and the housing 400 may be maintained as shapes of the first to third protrusion portions 522, 524, and 526 are deformed.

Also, as illustrated in FIG. 5, the housing 400 may include a hook portion 410 which has a hook shape and is provided along a circumference of the through-hole defined in the housing 400. The hook portion 410 may be configured to couple the housing 400 to the sealing member 500. More specifically, the hook portion 410 may be configured to interfere with one end of the sealing member 500 when the sealing member 500 moves in the forward direction (in the right direction in FIG. 5). For this, the hook portion 410 and the first protrusion portion 522 may be connected to each other in a hook shape. That is, the hook portion 410 may be fastened to the first protrusion portion 522 in a hook coupling manner.

Also, referring to FIGS. 2 and 5, the heat dissipating module 300 may further include a connection portion 340 in addition to the fixing portion 310, the first heat dissipating fin 320, and the second heat dissipating fin 330. Here, the connection portion 340 may be provided between the first heat dissipating fin 320 and the second heat dissipating fin 330 and face the sealing member 500. Thus, the second protrusion portion 524 may be in contact with the connection portion 340 of the heat dissipating module 300.

Here, the connection portion 340 may include an interference member 342 which protrudes toward the sealing member 500 to interfere with the sealing member 500 when the sealing member 500 moves in a forward direction (in a right direction in FIG. 5) or in a rearward direction (in a left direction in FIG. 5). The interference member 342 may be configured such that the sealing is enhanced by the interference between the heat dissipating module 300 and the sealing member 500. That is, according to the present disclosure, an inflow of foreign substances such as moisture from the outside may be prevented by the height of the interference member 342 that protrudes toward the sealing member 500. More specifically, the second protrusion portion 524 may interfere with the interference member 342 when the sealing member 500 moves in the forward direction or in the rearward direction.

Here, the interference member 342 may include a first interference member 343 provided in front of the sealing member 500 and a second interference member 344 provided in rear of the sealing member 500. That is, according to the present disclosure, the plurality of interference members 342 may be provided. In this case, it is possible to block an inflow of foreign substances such as moisture from a region in rear of the sealing member 500 (that is, the second interference member 344). Also, even if the foreign substances flow in through the region in rear of the sealing member 500, the inflow of the foreign substances may be blocked again in a region in front of the sealing member 500 (that is, the first interference member 343). Also, when the sealing member 500 moves in the forward direction, the sealing member 500, that is, the second protrusion portion 524 interferes with the first interference member 343. When the sealing member 500 moves in the rearward direction, the sealing member 500, that is, the second protrusion portion 524 interferes with the second interference member 344. Thus, the coupling between the sealing member 500 and the heat dissipating module 300 may be stably maintained.

Also, as illustrated in FIG. 5, the height of the first interference member 343 may be greater than the height of the second interference member 344. Unlike the above, however, the height of the first interference member 343 may be less than the height of the second interference member 344, or the height of the first interference member 343 may be equal to the height of the second interference member 344.

Also, as described above, the first interference member 343 may be provided in front of the sealing member 500, and the second interference member 344 may be provided in rear of the sealing member 500. Here, the sealing member 500 may be inserted between the first interference member 343 and the second interference member 344. As described above, the sealing member 500 is inserted between the first interference member 343 and the second interference member 344, and this may represent that the lowermost end of the sealing member 500, that is, the lowermost end of the second protrusion portion 524 is provided below the uppermost end of the first interference member 343 and the uppermost end of the second interference member 344. Unlike the above, however, the sealing member 500 may not be inserted between the first interference member 343 and the second interference member 344. For example, the lowermost end of the sealing member 500, that is, the lowermost end of the second protrusion portion 524 may be provided below the uppermost end of the first interference member 343 but may be provided above the uppermost end of the second interference member 344.

Continuing to refer to FIG. 5, the lamp 10 according to the present disclosure may further include a corrugated structure for enhancing a coupling force by increasing a friction force between the housing 400 and the sealing member 500 in a region in which the housing 400 and the sealing member 500 are in contact with each other. That is, as illustrated in FIG. 5, a corrugated portion 410*a* may be provided in a region of the hook portion 410 of the housing 400, which is in contact with one end of the sealing member 500.

Similar to the above, the lamp 10 according to the present disclosure may also further include a corrugated structure for enhancing a coupling force by increasing a friction force between the heat dissipating module 300 and the sealing member 500 in a region in which the heat dissipating module 300 and the sealing member 500 are in contact with each other. That is, as illustrated in FIG. 5, a corrugated portion 340*a* may be provided in a region of the connection portion 340 of the heat dissipating module 300, which is between the first interference member 343 and the second interference member 344.

Also, thicknesses of the protrusion portion 520 provided in the sealing member 500 in the lamp 10 according to the present disclosure may be different from each other for regions. For example, as illustrated in FIG. 5, the thickness of the second protrusion portion 524 may be less than the thickness of the first protrusion portion 522. In this case, when the shape of the protrusion-recess section 510 of the sealing member 500 is deformed as the relative movement between the heat dissipating module 300 and the housing 400 occurs, deformation of the second protrusion portion 524 may be relatively greater than that of the first protrusion portion 522.

As described above, the first protrusion portion 522 is fastened to the hook portion 410 in a hook coupling manner, and the hook coupling has to be maintained so that the sealing member 500 is not separated from the housing 400. Thus, the deformation of the shape of the first protrusion portion 522 needs to be relatively small. However, since the shape of the protrusion-recess section 510 has to be deformed when the relative movement between the heat dissipating module 300 and the housing 400 occurs, relatively greater shape deformation needs to occur in the second protrusion portion 524. The content described above for the thickness of the first protrusion portion 522 and the thickness of the second protrusion portion 524 may be a feature for satisfying the conditions required in the first protrusion portion 522 and the second protrusion portion 524.

Also, the thickness of a region of the third protrusion portion 526, which is adjacent to the first protrusion portion 522, may be equal to the thickness of the first protrusion portion 522. The thickness of a region of the third protrusion portion 526, which is adjacent to the second protrusion portion 524, may be equal to the thickness of the second protrusion portion 524. In this case, when the relative movement between the heat dissipating module 300 and the housing 400 occurs, relatively great deformation may occur in the region of the third protrusion portion 526 adjacent to the second protrusion portion 524.

Also, the first heat dissipating fin 320 and the second heat dissipating fin 330, which are disposed with the connection portion 340 therebetween, may have different shapes and structures. That is, as described above, the first heat dissipating fin 320 may be provided in the inner space of the housing 400. Also, as illustrated in FIG. 2, the light source 600 may be mounted to the first heat dissipating fin 320. Thus, heat generated in the light source 600 needs to be rapidly diffused to the first heat dissipating fin 320 through conduction so that the heat generated in the light source 600 is quickly discharged to the outside. For this, the first heat dissipating fin 320 may include a vertical fin having a plate shape as illustrated in FIG. 2. More preferably, the first heat dissipating fin 320 may be made of a plurality of vertical fins.

On the other hand, the second heat dissipating fin 330 provided in the outside of the housing 400 needs to quickly discharge the heat, which is supplied from the first heat dissipating fin 320, to outside air. For this, the second heat dissipating fin 330 may have a structure of which a surface in contact with the outside air is large. For example, the second heat dissipating fin 330 may include a pin-type fin. More preferably, the second heat dissipating fin 330 may be made of a plurality of pin-type fins.

Automobile

An automobile according to the present disclosure may include a lamp 10 capable of performing aiming in an up-down direction or in a left-right direction. Here, the lamp 10 may include a lens 100 provided on the front outer side, a lens holder 200 coupled to the lens 100 to fix the lens 100, and a heat dissipating module 300 coupled to the lens holder 200 in rear of the lens holder 200. Also, the lamp 10 may include a housing 400 having a space for accommodating the lens 100, the lens holder 200, and the heat dissipating module 300. The housing 400 has a through-hole which is provided in a rear side surface thereof and through which the heat dissipating module 300 passes. In addition, the lamp 10 may further include a sealing member 500 provided between the heat dissipating module 300 and the housing 400 in the through-hole provided in the housing 400. Here, the sealing member 500 may include a protrusion-recess section 510 having flexibility. The description of the structure and function of the protrusion-recess section 510 is replaced with the above description.

Also, the aiming of the lamp 10 according to the present disclosure may be performed by rotating and moving the lens holder 200 in the up-down direction or in the left-right direction.

According to the present disclosure, the lamp for an automobile, which is equipped with the heat sink having the improved heat dissipation efficiency as compared to the related art, may be manufactured.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp comprising:

a lens located at a front portion of the lamp;

a lens holder coupled to the lens and configured to hold the lens;

a heat dissipating module coupled to the lens holder and configured to dissipate heat generated by the lamp;

a housing having a space configured to accommodate the lens, the lens holder and the heat dissipating module, wherein the heat dissipating unit has a portion laterally extending externally from within the housing through a through-hole located at a rear portion of the housing; and a sealing member coupled between the heat dissipating module and the housing, extending along a circumference of the through-hole, and comprising a flexible protrusion-recess section, wherein the flexible protrusion-recess section comprises a plurality of protrusion portions, each protrusion portion protruding in a forward or rearward direction of the lamp, the forward and rearward direction being parallel to a direction in which the heat dissipating module extends laterally from within the housing through the through-hole.

2. The lamp of claim 1, wherein the housing comprises a hook portion which is provided along a circumference of the through-hole and has a hook shape configured to interfere with one end of the sealing member when the sealing member moves in the forward direction.

3. The lamp of claim 2, wherein the heat dissipating module comprises a connection portion that faces the sealing member, wherein the connection portion comprises an interference member which protrudes toward the sealing member to interfere with the sealing member when the sealing member moves in the forward or rearward direction.

4. The lamp of claim 3, wherein the heat dissipating module further comprises:

a fixing portion provided in an inner space of the housing and coupled to the lens holder;

a first heat dissipating fin provided in rear of the fixing portion within the inner space of the housing; and a second heat dissipating fin provided in an outer space of the housing, wherein the connection portion is provided between the first heat dissipating fin and the second heat dissipating fin.

5. The lamp of claim 4, wherein the first heat dissipating fin comprises a vertical fin having a plate shape, and the second heat dissipating fin comprises a pin-type fin.

6. The lamp of claim 3, wherein the interference member comprises:

a first interference member provided in front of the sealing member; and a second interference member provided in rear of the sealing member.

7. The lamp of claim 6, wherein a height of the first interference member is greater than a height of the second interference member.

8. The lamp of claim 6, wherein the sealing member is inserted between the first interference member and the second interference member.

9. The lamp of claim 8, wherein a corrugated portion is provided in an area of the connection portion, which is between the first interference member and the second interference member.

10. The lamp of claim 3, wherein the flexible protrusion-recess section comprises:

a first protrusion portion protruding in the rearward direction and fastened to the hook portion in a hook coupling manner;

a second protrusion portion protruding in the rearward direction and interfering with the interference member when the sealing member moves in the forward or rearward direction; and a third protrusion portion protruding in the forward direction and provided between the first protrusion portion and the second protrusion portion.

11. The lamp of claim 10, wherein a thickness of the second protrusion portion is less than a thickness of the first protrusion portion.

12. The lamp of claim 2, wherein a corrugated portion is provided in an area of the hook portion, which is in contact with the end of the sealing member.

13. An automobile comprising the lamp of claim 1, wherein the lamp is configured to vertically or horizontally adjust an aiming direction of the lamp.

14. The automobile of claim 13, wherein the lens holder is configured to rotate and move to vertically or horizontally adjust the aiming direction of the lamp.

* * * * *